US012378906B1

(12) United States Patent
Karim et al.

(10) Patent No.: US 12,378,906 B1
(45) Date of Patent: Aug. 5, 2025

(54) EXHAUST MANIFOLD ASSEMBLY FOR INTERNAL COMBUSTION ENGINE

(71) Applicant: Caterpillar Inc., Peoria, IL (US)

(72) Inventors: Md Anwarul Karim, Peoria, IL (US); Zhengfei Hu, Wuxi (CN); Ryan M. Brown, West Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/736,846

(22) Filed: Jun. 7, 2024

(51) Int. Cl.
*F01N 3/04* (2006.01)

(52) U.S. Cl.
CPC ..... *F01N 3/046* (2013.01); *F01N 2260/024* (2013.01)

(58) Field of Classification Search
CPC ..... F01N 13/10; F01N 13/141; F01N 3/046
See application file for complete search history.

(56) References Cited

U.S. PATENT DOCUMENTS 4,179,884 A * 12/1979 Koeslin ..... F01N 13/10 60/322
4,918,917 A * 4/1990 Woods ..... F01N 3/043 60/605.1
5,109,668 A * 5/1992 Lindstedt ..... F01N 3/046 60/323
5,148,675 A * 9/1992 Inman ..... F01N 3/043 60/322
5,311,738 A * 5/1994 Huster ..... F01N 13/16 60/322
8,733,088 B2 5/2014 Reinhart et al.
9,422,857 B2 * 8/2016 McHenry ..... F01N 13/1861
9,695,721 B2 * 7/2017 Maloney ..... F01N 13/1855
9,771,852 B2 9/2017 Steigert et al.
10,794,255 B2 * 10/2020 Papadimitriou ..... F01N 13/10
2007/0209353 A1 9/2007 Zelinski
2014/0208726 A1 * 7/2014 Karim ..... F01N 13/102 60/321

FOREIGN PATENT DOCUMENTS

DE 102010015543 10/2011
WO 2011115108 9/2011
WO 2020043222 3/2020

* cited by examiner

*Primary Examiner* — Anthony Ayala Delgado
(74) *Attorney, Agent, or Firm* — Schwegman Lundberg & Woessner, P.A.

(57) ABSTRACT

Examples include an exhaust manifold assembly for an internal combustion engine, the exhaust manifold assembly optionally including: an inner housing configured to receive an exhaust gas from a cylinder head of the internal combustion engine; an outer housing receiving at least a portion of the inner housing, wherein the outer housing is configured to receive a coolant flow that passes over the at least the portion of the inner housing; and a plurality of manifold flanges coupled to the outer housing and configured to mount on the cylinder head, wherein at least one of the plurality of manifold flanges has a sleeve portion forming a passage that receives a part of the inner housing therein and receives the coolant flow.

16 Claims, 8 Drawing Sheets

EXHAUST MANIFOLD ASSEMBLY FOR INTERNAL COMBUSTION ENGINE

TECHNICAL FIELD

The present application relates generally to internal combustion engines. More particularly, the present application relates to exhaust systems including exhaust manifolds of internal combustion engines.

BACKGROUND

Machinery, for example, agricultural, industrial, construction or other heavy machinery can be propelled by an internal combustion engine(s). Internal combustion engines can be used for other purposes such as for power generation. Internal combustion engines combust a mixture of air and fuel(s) in cylinders and thereby produce drive torque and power. Internal combustion engines may be designed to run on various fuel(s) such as gasoline fuel, in which a spark plug initiates combustion, on diesel fuel, that is compression ignited, or on other fuels, such as gaseous fuels.

Products of combustion must be handled for regulatory compliance. Internal combustion engines have exhaust systems for such purposes. These can be mounted to the cylinder head and can be water cooled. For example, German Patent Application No. DE102010015543A1 and United State Patent Application No. US20070209353A1 each describe an exhaust gas manifold cooling water circuit that cools an exhaust gas manifold. However, each of these Patent Applications has a different manifold configuration and assembly methodology than is contemplated in the present application.

SUMMARY OF THE INVENTION

In one example, an exhaust manifold assembly for an internal combustion engine, the exhaust manifold assembly optionally including: an inner housing configured to receive an exhaust gas from a cylinder head of the internal combustion engine; an outer housing receiving at least a portion of the inner housing, wherein the outer housing is configured to receive a coolant flow that passes over the at least the portion of the inner housing; and a plurality of manifold flanges coupled to the outer housing and configured to mount on the cylinder head, wherein at least one of the plurality of manifold flanges has a sleeve portion forming a passage that receives a part of the inner housing therein and receives the coolant flow.

In another example, a method of assembling an exhaust manifold for an internal combustion engine, optionally including: inserting a plurality of manifold flanges within recesses in an outer housing; positioning one or more portions of an inner housing within the outer housing; adjusting a position of the outer housing relative to one or more of the plurality of manifold flanges; welding the outer housing to the plurality of manifold flanges adjacent an outer perimeter region of a sleeve portion; and coupling the outer housing to the inner housing at a first end flange.

In another example, an internal combustion engine optionally including: an engine block; a cylinder head coupled to the engine block; and an exhaust manifold assembly coupled to the cylinder head, the exhaust manifold assembly including: an inner housing receiving an exhaust gas from the cylinder head; an outer housing receiving at least a portion of the inner housing and receiving a coolant flow that passes along a length of the outer housing between the inner housing and the outer housing; and a plurality of manifold flanges coupled to the outer housing and spaced from one another along the length thereof, wherein the plurality of manifold flanges are mounted on the cylinder head, wherein each of the plurality of manifold flanges has a sleeve portion forming a passage that receives a part of the inner housing therein and receives the coolant flow.

DETAILED DESCRIPTION

Examples of the present disclosure are now described with reference to the accompanying drawings. The following description is merely exemplary in nature and is not intended to limit the present disclosure, application, or use. Examples described set forth specific components, devices, and methods, to provide an understanding of embodiments of the present disclosure. It will be apparent to those skilled in the art that specific details need not be employed and that examples may be embodied in many different forms. Thus, the examples provided should not be construed to limit the scope of the claims.

As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Further, relative terms, such as, for example, "about," "substantially," "generally," and "approximately" are used to indicate a possible variation of ±10% in a stated value. Although the present application utilizes an example of a internal combustion engine that utilizes diesel fuel the manifold constructions and assembly methodology described are applicable to other power generation platforms and internal combustion engines using other forms of fuel(s) including, for example, liquid fuel and/or gaseous fuel.

Figure 1:
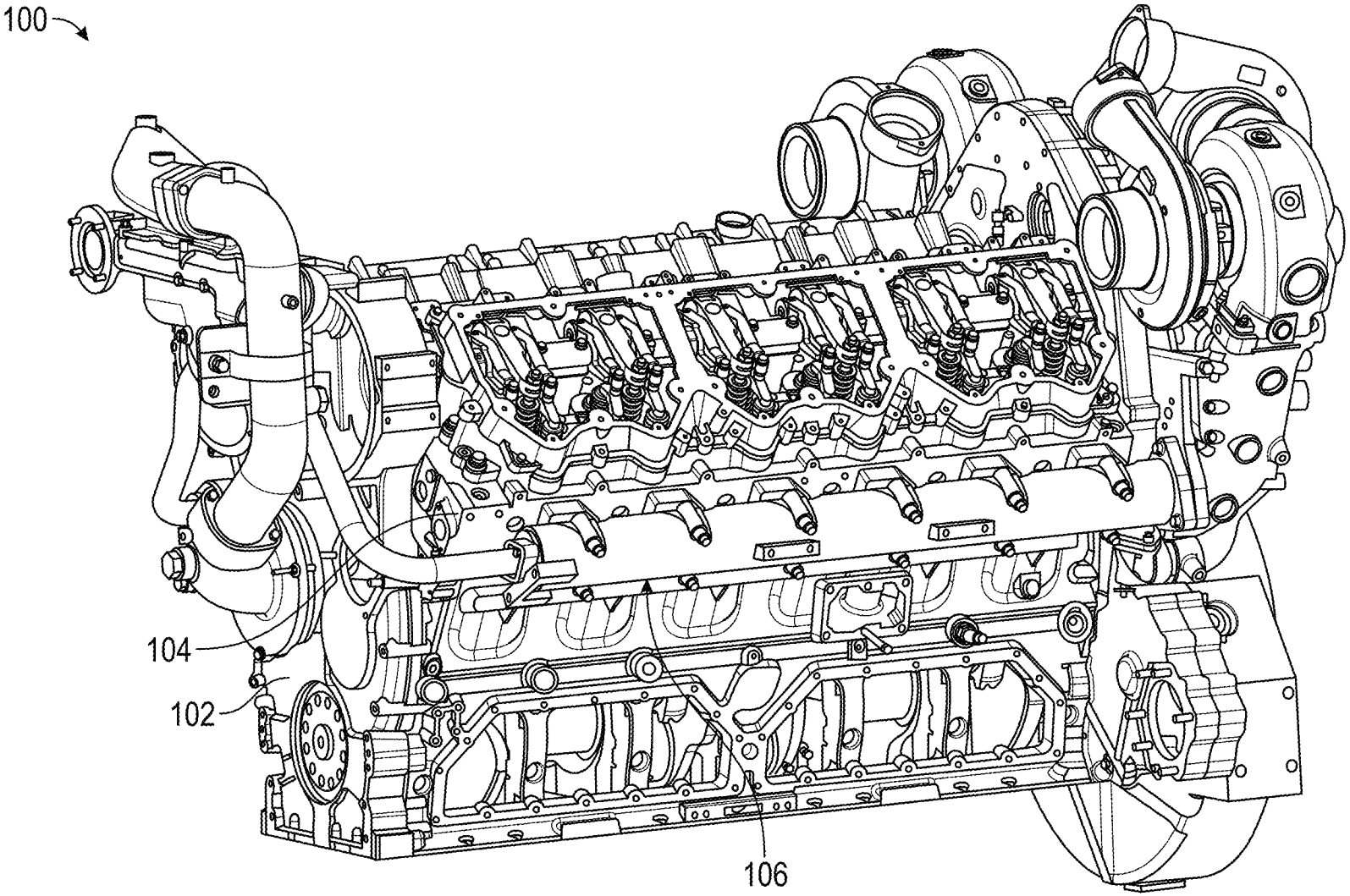
FIG. 1 is a perspective view of an example internal combustion engine having a cylinder head and exhaust manifold assembly.

FIG. 1 is a perspective view of an example internal combustion engine 100 that includes an engine block 102, a cylinder head 104 and an exhaust manifold assembly 106. The engine 100 can be used for power generation such as for the propulsion of vehicles or other machinery or for stationary power generation. Stationary engines may be used to drive immobile equipment, such as pumps, generators, mills, or factory equipment. It is understood that the present disclosure can apply to any number of piston-cylinder arrangements and a variety of engine configurations including, but not limited to, V-engines, inline engines, and horizontally opposed engines, as well as overhead cam and cam-in-block configurations. Vehicles and working machinery that can be driven include those related to various industries, including, as examples, construction, agriculture, forestry, transportation, material handling, waste management, etc. During operation of the internal combustion engine 100, combustion of fuel(s) occurs, which, in turn, provides work on the pistons to produce motion upon the crankshaft to drive an output. Exhaust gas results from combustion and is handled by an exhaust system of the internal combustion engine 100. The exhaust system includes the exhaust manifold assembly 106 among other components. The exhaust manifold assembly 106 can be coupled to a riser or other component. The exhaust manifold assembly 106 may be a water-cooled exhaust manifold to lower surface temperatures of the internal combustion engine 100, for example.

Figure 2:
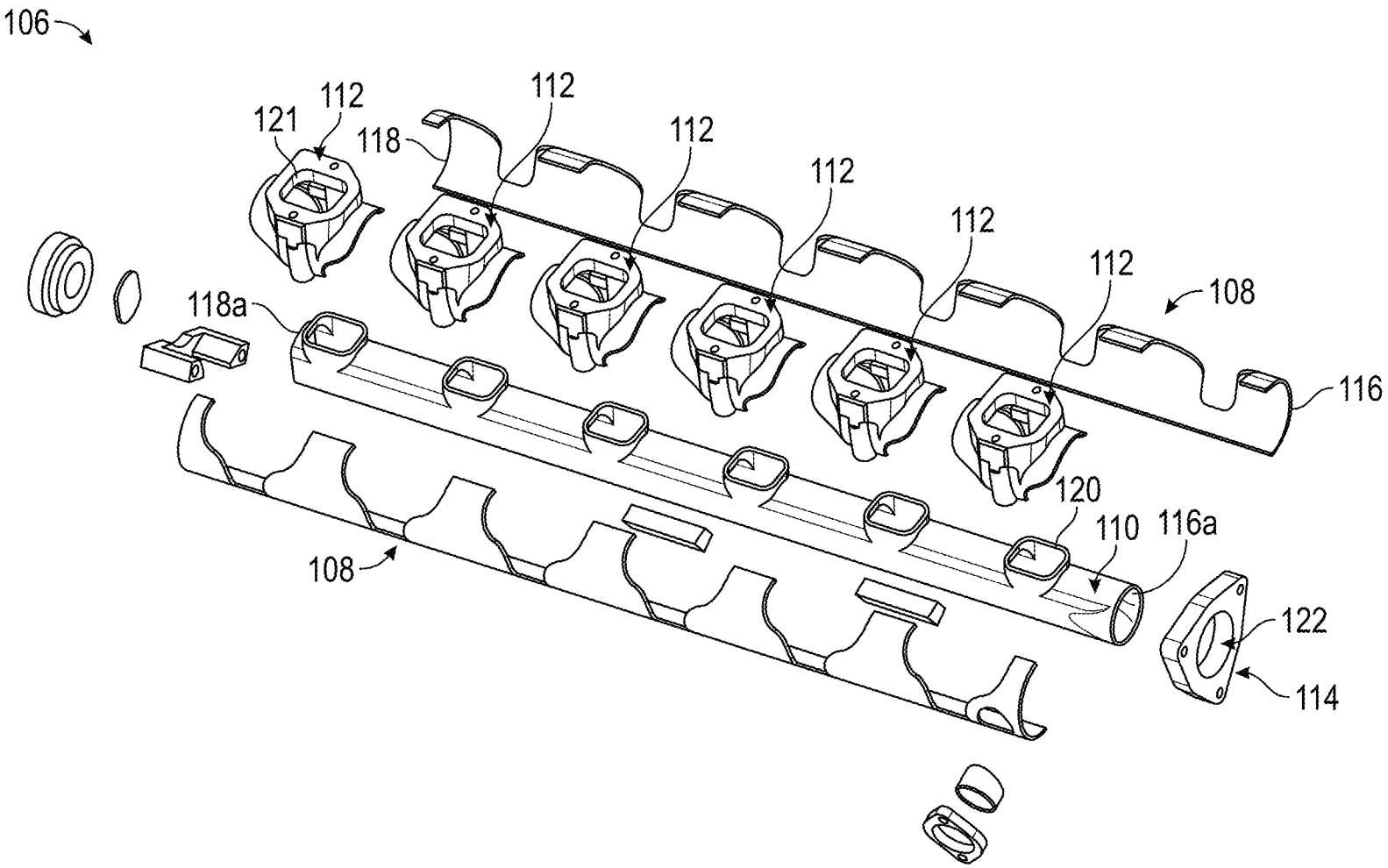
FIG. 2 is an exploded view of the exhaust manifold assembly according to various embodiments.

FIG. 2 is an exploded view of various components of the exhaust manifold assembly 106 including an outer housing 108, an inner housing 110, a plurality of manifold flanges 112, a first end flange 114 and other components such as plates, mounting brackets, flanges and tubes that are not specifically numbered. FIG. 2 illustrates the exhaust manifold assembly 106 from a different orientation than was previously shown in FIG. 1.

FIG. 2 illustrates the outer housing 108 disassembled into two halves that are can then coupled together during the fabrication process by welding or other know mechanical joining technique. This two half initial construction can facilitate insertion of the inner housing 110 therein and insertion of other components. However, other embodiments contemplate the outer housing 108 can be formed as a single piece by rolling, casting, extrusion or other known technique.

When joined, the outer housing 108 has a tube-like shape with an elongate length extending from a first end 116 to a second end 118. The first end 116 can couple with the first end flange 114 as further described herein. The second end 118 can be coupled with an end plate (shown but not specifically numbered in FIG. 2). This end plate can be configured to receive the coolant flow and pass it to the outer housing 108. The inner housing 110 is a separate component from the outer housing 108. The inner housing 110 can be configured to receive exhaust gas from the cylinder head (e.g., the cylinder head 104 of FIG. 1) via openings 120. The number of openings 120 corresponds to the number of cylinders utilized by the internal combustion engine. As such the number and shape of openings 120 can vary and is purely exemplary.

When the exhaust manifold assembly 106 is assembled as further discussed and illustrated herein, the inner housing 110 can be at least partially received within the outer housing 108. When assembled, the outer housing 108 is configured to receive the coolant flow (e.g., water flow) that passes over the at least the portion of the inner housing 110. The inner housing 110 can have a tube-like shape with an elongate length extending from a first end 116*a* to a second end 118*a*. The first end 116*a* can couple with the first end flange 114 as further described herein. The second end 118*a* can terminate prior to and can be spaced from the end plate (shown but not specifically numbered in FIG. 2). The openings 120 can be spaced apart at intervals along the elongate length. Although the inner housing 110 and outer housing 108 are shown as tube-like cylinders, other shapes are contemplated according to other embodiments. The inner housing 110 can be received by the outer housing 108 for a majority of the elongate length. However, the inner housing 110 may be positioned relative to the outer housing 108 such that the first end 116*a* can protrude slightly from the outer housing 108. The first end 116*a* can be captured by the first end flange 114 and can be coupled to the first end flange 114 at an aperture 122 of the first end flange 114 when assembled.

During fabrication and assembly, the plurality of manifold flanges 112 can initially be separate components from the outer housing 108 and the inner housing 110. For example, the plurality of manifold flanges 112 can be cast components that are then welded or otherwise mechanically joined to the outer housing 108 as further illustrated and described herein. The plurality of manifold flanges 112 are arranged at spaced intervals corresponding to the openings 120. Thus, the number of the plurality of manifold flanges 112 can correspond to the number of cylinders used in the internal combustion engine according to some embodiments. The plurality of manifold flanges 112 are illustrated as having an identical construction in FIG. 2. However, in other embodiments the plurality of manifold flanges 112 may have a construction that differs (e.g., one or more of the plurality of manifold flanges 112 have a first construction while others of plurality of manifold flanges 112 have a second construction). When assembled as further illustrated herein, the plurality of manifold flanges 112 are coupled to the outer housing 108 and are configured to mount on the cylinder head (see FIG. 1). As further illustrated and described, at least one of the plurality of manifold flanges 112 (or all of the plurality of manifold flanges 112) has a sleeve portion forming a passage that receives a part of the inner housing 110 therein and receives the coolant flow. The plurality of manifold flanges 112 each have openings 121 therein for passage of the exhaust gas via the openings 120 of the inner housing 110. Thus, portions of the inner housing 110 that form the openings 120 can be received within the openings 121 of the plurality of manifold flanges 112.

The first end flange 114 can have a triangular shape. However, other shapes are contemplated according to other embodiments. The first end flange 114 can have the aperture 122 therein. This aperture 122 and the construction of the first end flange 114 facilitates passage of the exhaust gas from the inner housing 110 and the exhaust manifold assembly 106 to other components of the exhaust system such as the riser. The first end flange 114 forms at least a portion of a first end of the exhaust manifold assembly 106. The first end flange 114 is coupled to the outer housing 108 and the inner housing 110. The first end flange 114 is configured to receive the coolant flow within a pocket therein as further illustrated and described.

Figure 3A:
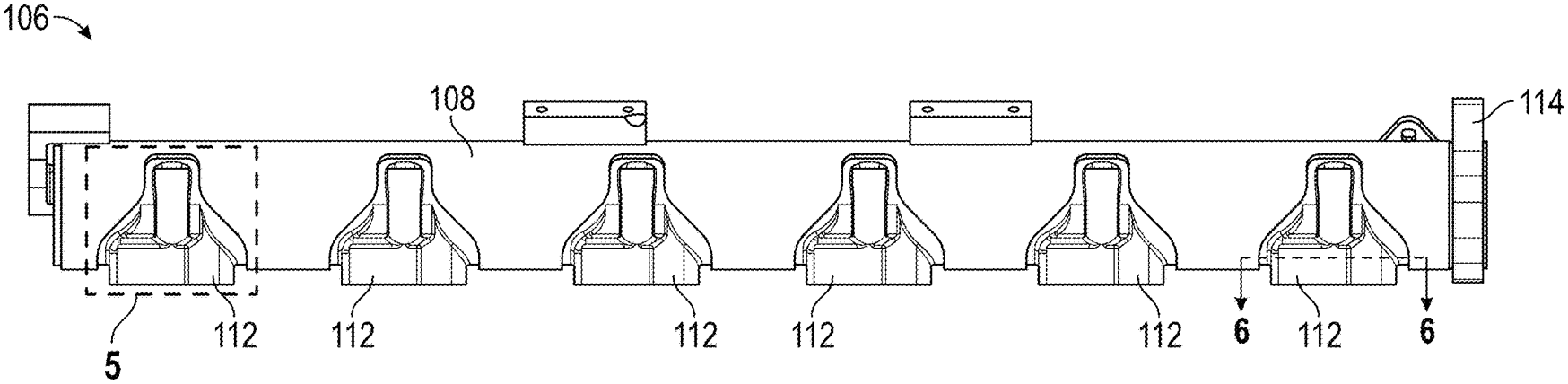
FIG. 3A is a plan view of a side of the exhaust manifold assembly of FIG. 2.
Figure 3B:
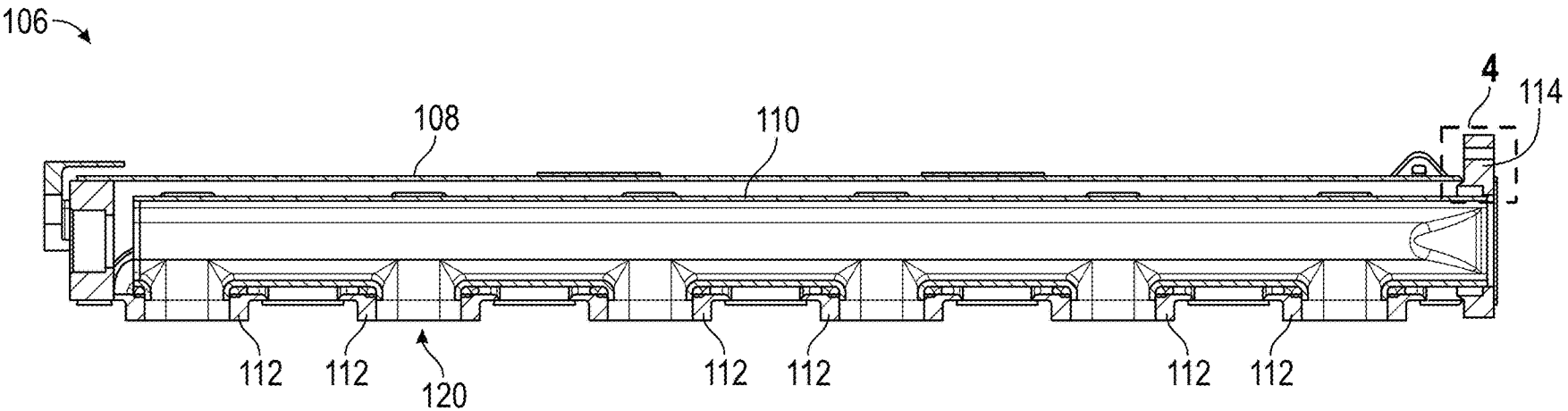
FIG. 3B is a cross-sectional view of the exhaust manifold assembly of FIG. 3A.

FIG. 3A is a side view of the exhaust manifold assembly 106 when assembled. FIG. 3B is a cross-sectional view of the exhaust manifold assembly 106 of FIG. 3A. FIGS. 3A and 3B illustrate the exhaust manifold assembly 106 from a different orientation than was previously shown in FIGS. 1 and 2.

FIG. 3A illustrates the plurality of manifold flanges 112 arranged along and partially captured within the outer housing 108 when assembled. The plurality of manifold flanges 112 are coupled to the outer housing 108 as further described herein. The first end flange 114 is spaced from the plurality of manifold flanges 112 and is coupled to the outer housing 108.

FIG. 3B shows the inner housing 110 positioned within the outer housing 108. The inner housing 110 is spaced from the outer housing 108 by gaps used for the passage of the coolant flow. The inner housing 110 is coupled to the plurality of manifold flanges 112 and is coupled to the first end flange 114. The openings 120 are surrounded by the plurality of manifold flanges 112. The plurality of manifold flanges 112 are additionally configured to allow for the coolant flow to pass around the inner housing 110 adjacent the openings 120 as further illustrated and described.

Figure 4:
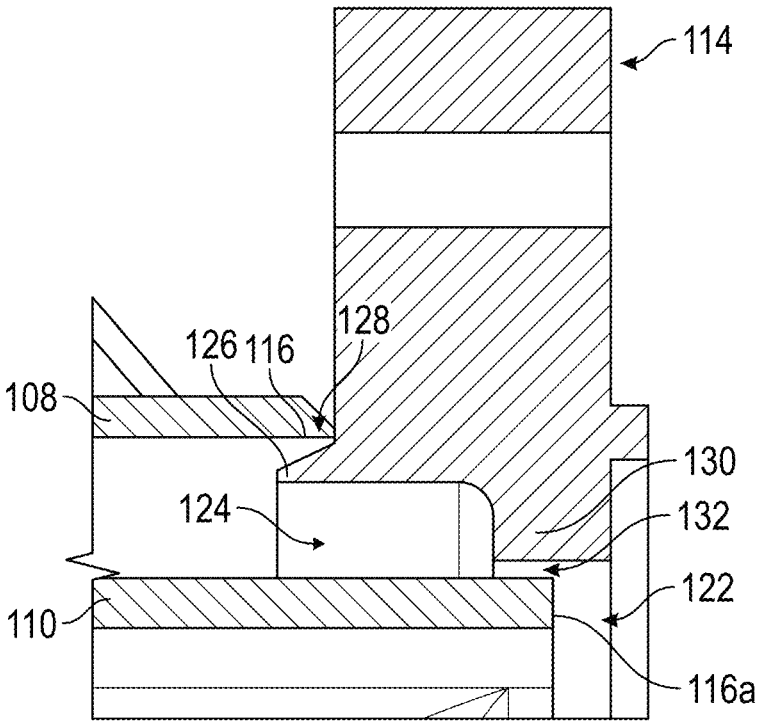
FIG. 4 is an enlarged view of a first end flange from FIG. 3B according to various embodiments.

FIG. 4 is an enlarged cross-sectional view from FIG. 3B showing a portion of the first end flange 114. FIG. 4 illustrates part of the aperture 122 formed by the first end flange 114. FIG. 4 additionally shows the first end flange 114 includes a pocket 124, a first flange 126, a first joint 128, a second flange 130 and a second joint 132.

The pocket 124 can be configured to receive at least a portion of the coolant flow therein. Thus, the pocket 124 provides cooling for the first end flange 114. The first flange 126 can be adjacent an opening to the pocket 124 and can form a portion of the pocket 124 in some embodiments. The first flange 126 can be configured (shaped, sized, positioned, etc.) to be received by the first end 116 of the outer housing 108. Thus, the first flange 126 can extend into an interior of the outer housing 108. The first flange 126 can be tapered or otherwise configured to form the first joint 128 with the outer housing 108. The first end flange 114 can be coupled to the outer housing 108 at the first joint 128 using welding, gasket (not shown) or other mechanical joining technique as known in the art.

The second flange 130 can form a second portion of the pocket 124 that is spaced from the portion of the pocket 124 formed by the first flange 126. The second flange 130 can be arranged and can extend generally perpendicular to the first flange 126. The second flange 130 can extend radially inward and can form an inner diameter of the first end flange 114. The second flange 130 can interface with the inner housing 110 at the first end 116*a* thereof and can be coupled thereto at the second joint 132. Such coupling at the second joint 132 can be via welding, gasket (not shown) or other mechanical joining technique as known in the art.

Figure 5:
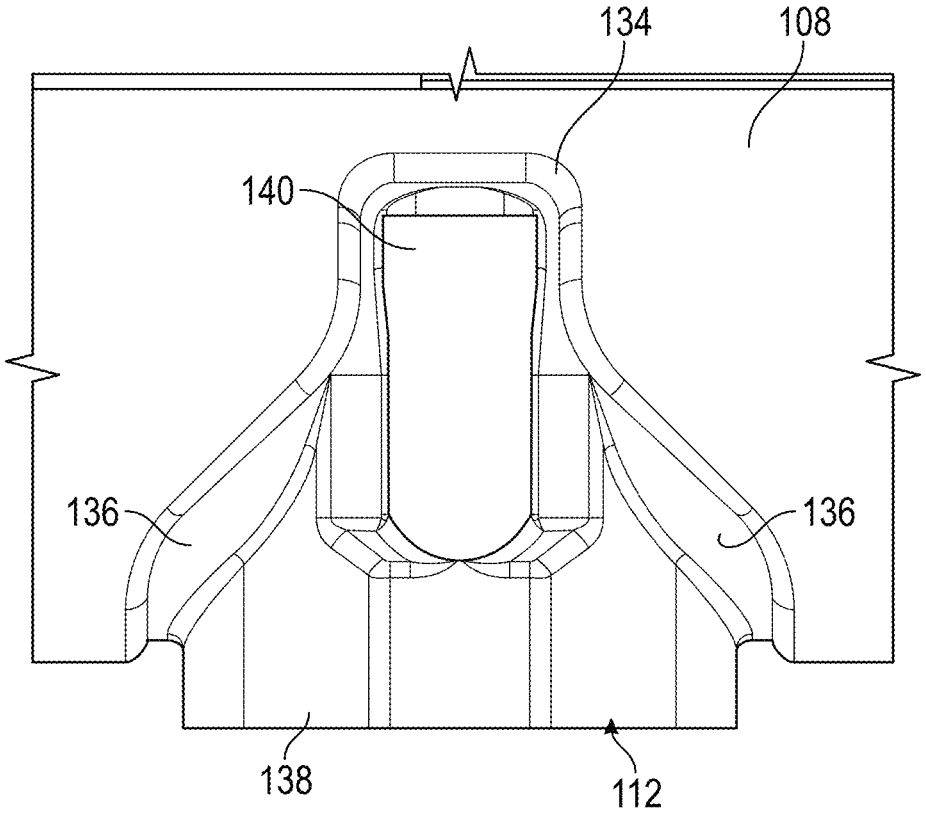
FIG. 5 is an enlarged view of one of a plurality of manifold flanges welded to an outer housing from FIG. 3A according to various embodiments.

FIG. 5 shows one of the plurality of manifold flanges 112 of FIG. 3A partially received in and coupled to the outer housing 108 as would be the case when the exhaust manifold assembly 106 is fully assembled. This coupling is via a weld 134 that extends along substantially an entirety of a sleeve portion 136 adjacent and along an outer perimeter region (not shown) of the sleeve portion 136 of the manifold flange 112. The weld 134 can be generally uniform (e.g., can generally have a same cross-sectional area along a full extent thereof) and is generally accessible. The weld 134 can be applied from exterior of the outer housing 108 and the manifold flanges 112.

The sleeve portion 136 can be connected to a foot portion 138 of manifold flange 112. The foot portion 138 can be configured to interface with and to mount on the cylinder head (not shown). The foot portion 138 can additionally form the openings 121 (FIG. 2) of the manifold flange 112 that receive the inner housing (not shown in FIG. 5). The foot portion 138 and the sleeve portion 136 can be connected to one or more bolt bosses 140. The one or more bolt bosses 140 are each configured to receive a bolt therein. The bolt (not shown but illustrated in FIG. 1) couples the exhaust manifold assembly 106 to the cylinder head. According to the embodiment of FIG. 5, the sleeve portion 136, the foot portion 138 and the one or more bolt bosses 140 can be integrated together so as be a single component rather than being initially separate components joined together by welding or other joining technique. Thus, the sleeve portion 136, the foot portion 138 and the one or more bolt bosses 140 can be formed by casting or other known fabrication technique. The one or more of plurality of manifold flanges 112 has the one or more bolt bosses 140 that are integrated with the sleeve portion 136.

Figure 6:
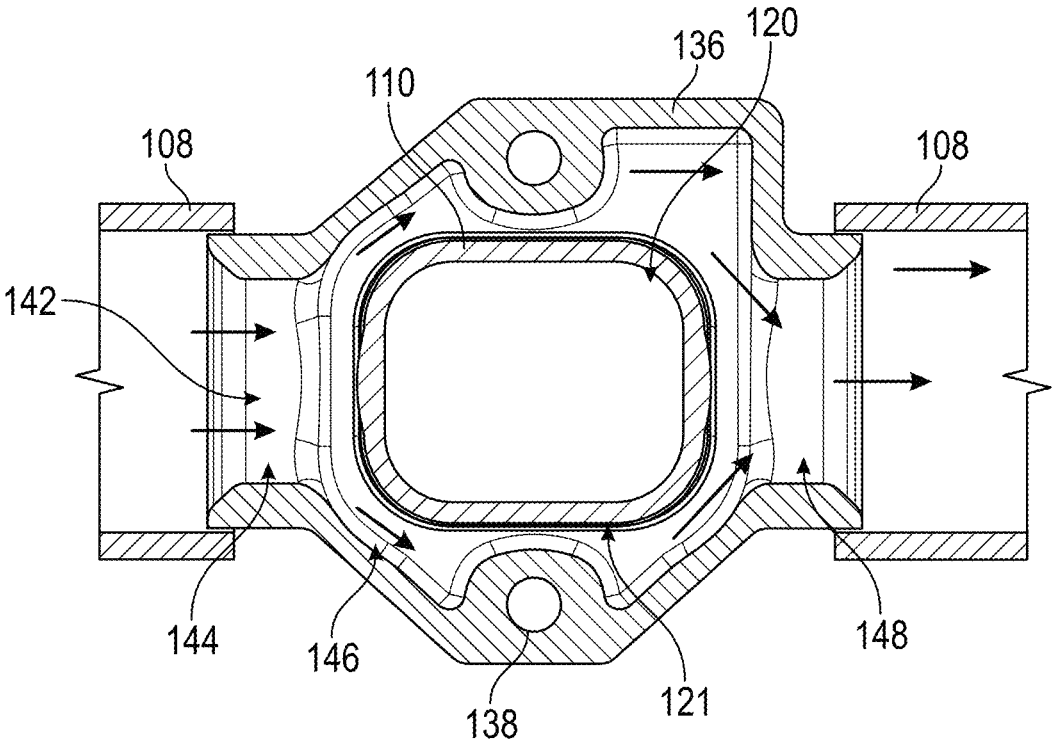
FIG. 6 is a cross-section view taken along line 6-6 of FIG. 3A showing internal features of and coolant flow through one of the plurality of manifold flanges according to various embodiments.

FIG. 6 is a cross-section of one of the plurality of manifold flanges 112 and additionally showing portions of the outer housing 108 and the inner housing 110. The cross-section of FIG. 6 is taken through the sleeve portion 136 adjacent the one or more bolt bosses 140 (FIG. 5) and through part of the foot portion 138 such that portions of the foot portion 138 including the portion that forms the opening 121 is illustrated. The inner housing 110 is shown in cross-section in FIG. 6 adjacent and forming one of the openings 120 thereto. FIG. 6 illustrates the coolant flow through a portion of the outer housing 108, the manifold flange 112 and around the inner housing 110. The coolant flow direction is indicated with arrows in FIG. 6.

As shown in FIG. 6, the sleeve portion 136 has an open shell configuration and forms a passage 142 therethrough. The passage 142 receives a part of the inner housing 110 therein and receives the coolant flow. The passage 142 can have a first converging region 144, a diverging region 146 and a second converging region 148 for the coolant flow. The first converging region 144 can be upstream relative to the coolant flow direction of the diverging region 146. The diverging region 146 can be upstream of the second converging region 148. The first converging region 144 can act as a venturi to increase the flow velocity of the coolant flow around the inner housing 110 and into the diverging region 146. The second converging region 148 can act as a venturi to increase coolant flow velocity into the outer housing 108.

Figure 7:
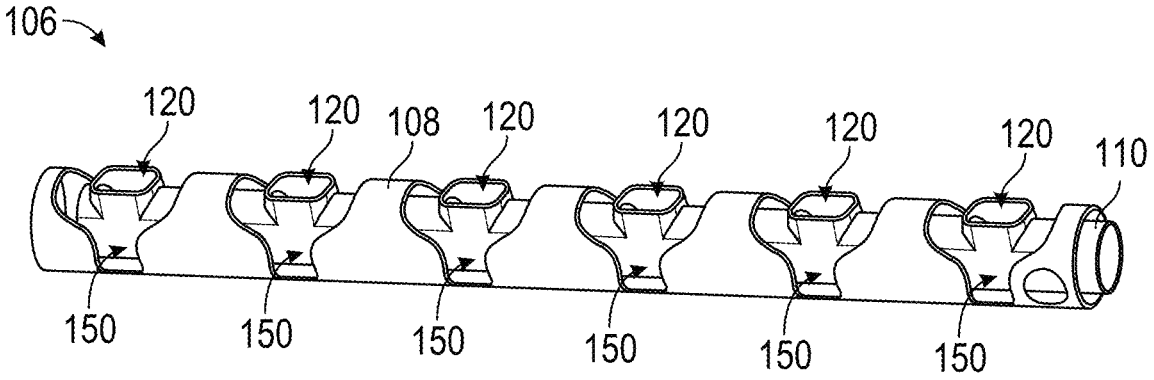
FIG. 7 is a perspective view the exhaust manifold assembly from a different orientation than shown in FIGS. 3A-6 with the plurality of manifold flanges and other components removed such that only an outer housing and an inner housing are illustrated.

FIG. 7 shows the exhaust manifold assembly 106 in an orientation similar to that of FIG. 2. Thus, the orientation of the exhaust manifold assembly 106 in FIG. 7 is altered from that of FIGS. 3A-6. In FIG. 7, only the outer housing 108 and the inner housing 110 are illustrated, with other components not shown. FIG. 7 illustrates the relative arrangement of the outer housing 108 relative to the inner housing 110 with the openings 120 arranged to receive exhaust gas. The inner housing 110 is received at least partially within the outer housing 108 and is spaced therefrom by gaps that facilitate the coolant flow (example of part of the coolant flow is previously shown in FIG. 6). FIG. 7 shows the outer housing 108 formed together as an assembly and forming recesses 150. The recesses 150 are spaced at intervals from one another around respective ones of the openings 120. The recesses 150 are configured to receive the plurality of manifold flanges (not shown) therein as previously illustrated such as in FIGS. 3A and 3B.

Figure 8:
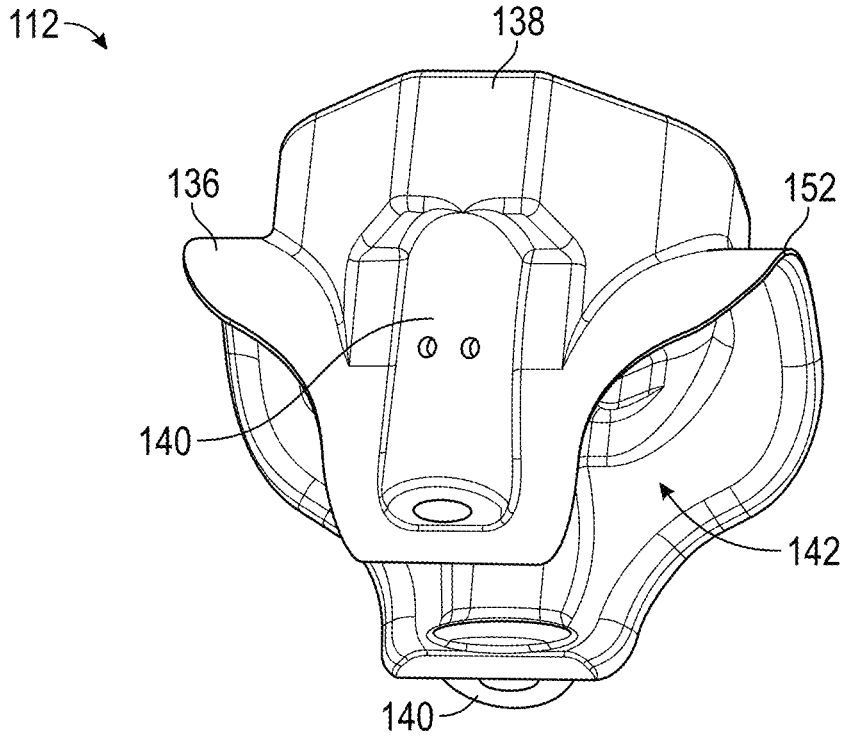
FIG. 8 is a perspective view of one of the plurality of manifold flanges according to various embodiments.

FIG. 8 shows a perspective view of one of the plurality of manifold flanges 112 including the sleeve portion 136, the foot portion 138 and the one or more bolt bosses 140. As discussed previously, the sleeve portion 136 can be integrated with the one or more bolt bosses 140 and/or the foot portion 138. The sleeve portion 136 can have an open shell configuration forming the passage 142. The sleeve portion 136 can be a flange or other projection from the one or mor bolt bosses 140 and the foot portion 138 and can have a general U-shape or saddle shape. Thus, the sleeve portion 136 can be hollow for accommodating the coolant flow and the inner housing (not shown).

FIG. 8 shows an outer perimeter region 152 of the sleeve portion 136. The outer perimeter region 152 extends substantially entirely around the perimeter of the sleeve portion 136 of the manifold flange 112 including adjacent but spaced form the one or more bolt bosses 140 and/or the foot portion 138. The sleeve portion 136, particularly in the outer perimeter region 152, can be configured to be inserted within one of the recesses 150 (FIG. 7) such that the manifold flange 112 can be received at least partially within and can overlap with the outer housing as further shown and described in FIGS. 10A-10C.

Figure 9:
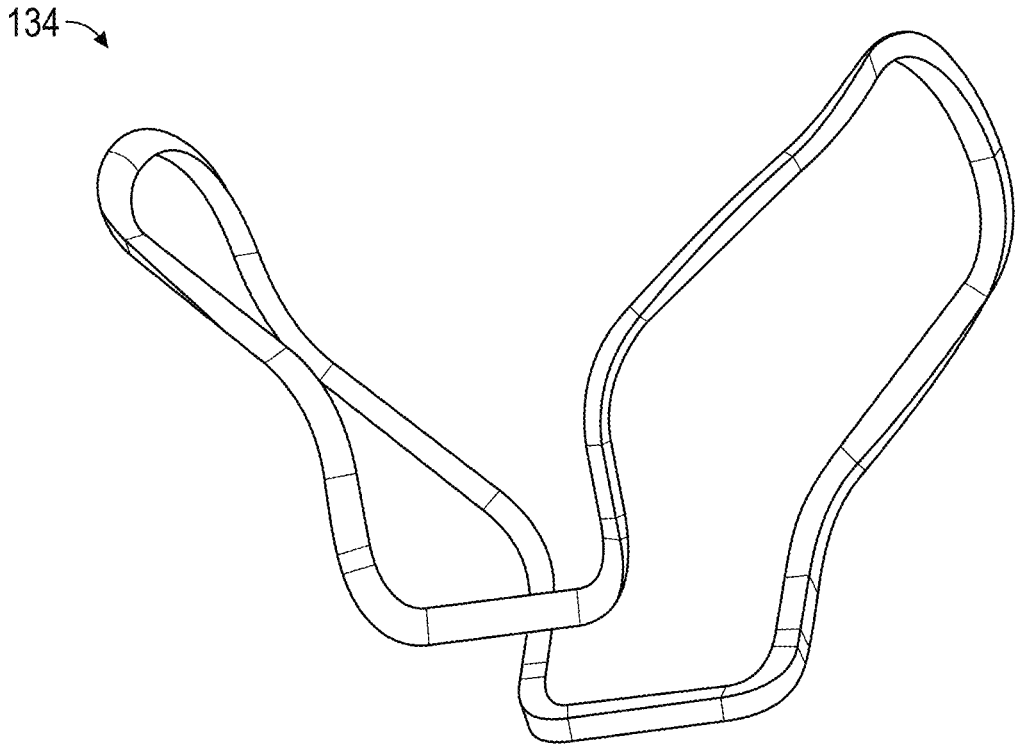
FIG. 9 shows an example of a weld used to couple the manifold flange of FIG. 8 to the outer housing of FIG. 7 according to various embodiments.

FIG. 9 illustrates the weld 134 in further detail. As discussed previously, the weld 134 can extend along the manifold flange 112, in particular, along the sleeve portion 136 thereof (see FIGS. 3A and 8) adjacent the outer perimeter region 152 (see FIGS. 3A and 8). Thus, the weld 134 can generally approximate and can have an extent similar to but not the same as that of the perimeter of the sleeve portion 136 (see FIGS. 3A and 8). The weld 134 can extend entirely around the sleeve portion 136 (see FIGS. 3A and 8). The weld 134 can be a fillet weld, for example. The weld 134 can be generally uniform in cross-sectional area and can form a closed loop path as shown in FIG. 9.

Figure 10A:
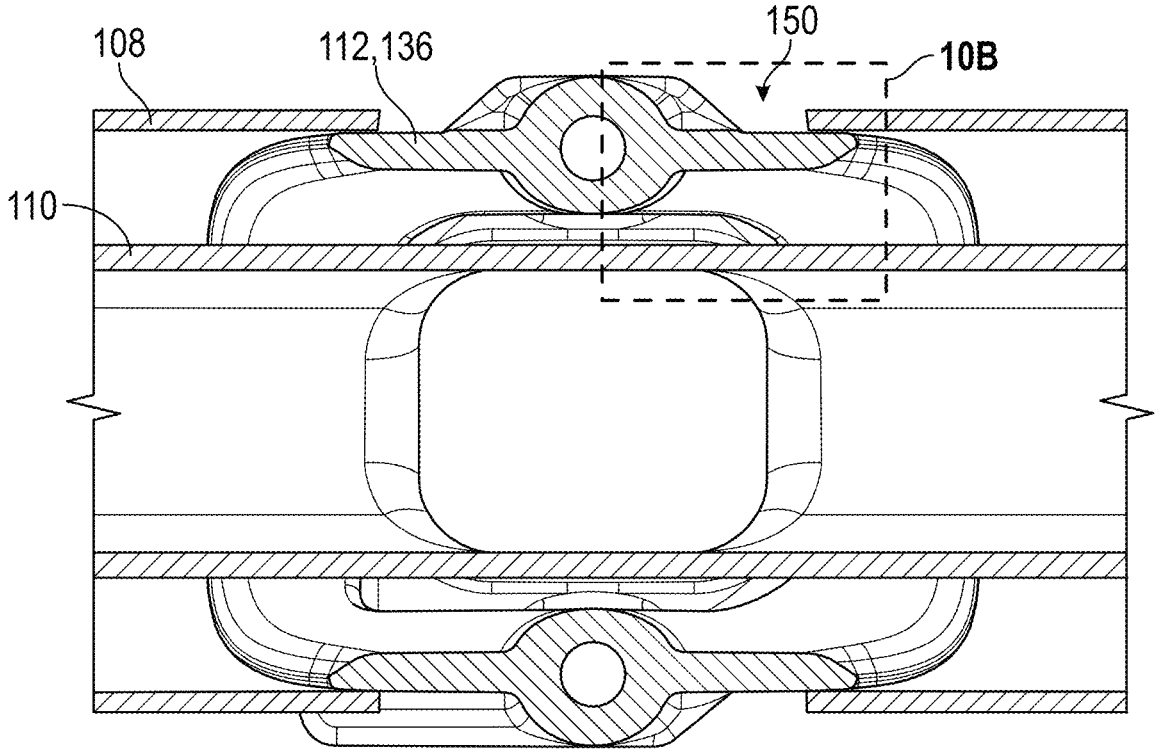
FIG. 10A is a first cross-sectional view of a portion of the outer housing, the inner housing and the one of the plurality of manifold flanges according to various embodiments.
Figure 10B:
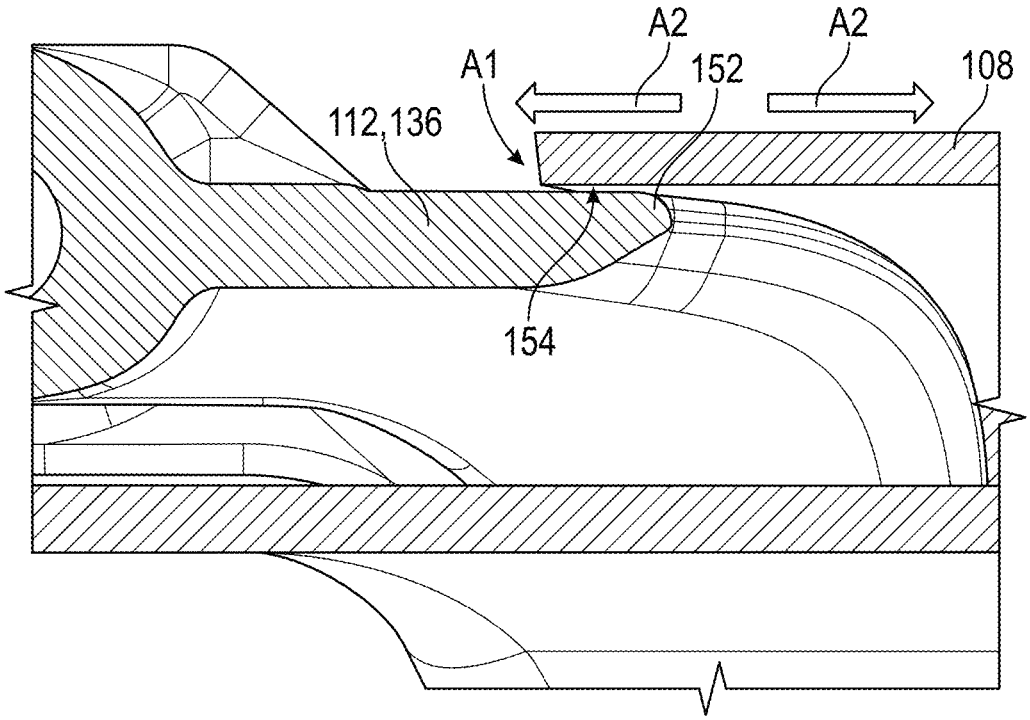
FIG. 10B is an enlarged cross-sectional view of a joint between the outer housing and the one of the plurality of manifold flanges of FIG. 10A.

FIG. 10A shows a cross-section of one of the plurality of manifold flanges 112 when inserted in one of the recesses 150 of the outer housing 108. The inner housing 110 is also illustrated in FIG. 10A. As shown in FIG. 10A and the enlarged cross-sectional view of FIG. 10B, the sleeve portion 136 can overlap the outer housing 108. This results in the sleeve portion 136 interfacing with and being inserted in the outer housing 108. This overlap of the sleeve portion 136 with the outer housing 108 forms a joint 154 at and adjacent the outer perimeter region 152 as labeled in FIG. 10B. FIG. 10B indicates the location of the weld (not shown in FIGS. 10A and 10B) with arrow A1. The weld can be placed adjacent, against and along the edge of the joint 154 and adjacent and along the outer perimeter region 152.

As shown in FIG. 10B, prior to welding or other coupling of the manifold flange 112 to the outer housing 108, the position of the outer housing 108 can be adjusted relative to the plurality of manifold flanges 112 as indicated by arrows A2. Thus, the present application contemplates that outer housing 108 is moveable relative to the plurality of manifold flanges 112 to adjust a position of the outer housing 108 relative to the plurality of manifold flanges 112 prior to the outer housing 108 being welded or otherwise joined to the plurality of manifold flanges 112.

Figure 10C:
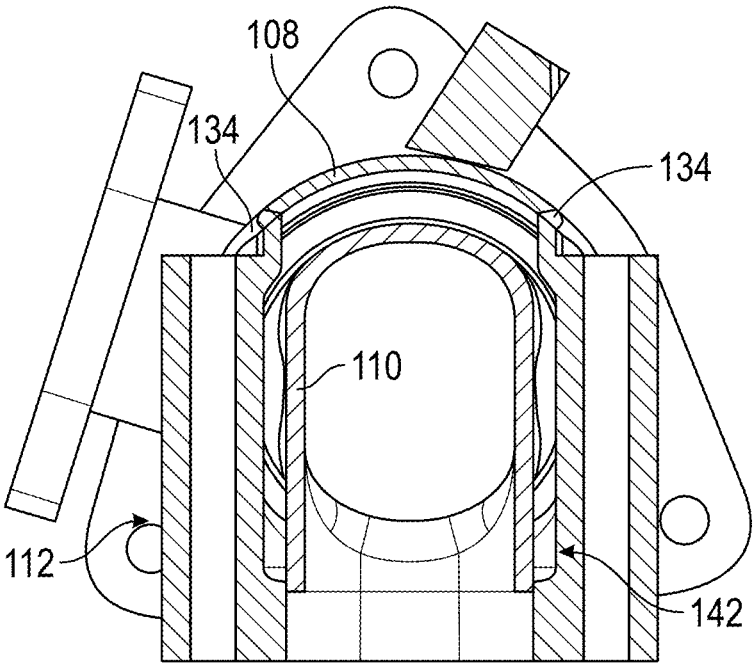
FIG. 10C is a second cross-sectional view of a portion of the outer housing, the inner housing and the one of the plurality of manifold flanges according to various embodiments.

FIG. 10C is a cross-section through the outer housing 108, the inner housing 110 and one of the plurality of manifold flanges 112 in a direction orthogonal to the cross-section of FIG. 10A. FIG. 10C illustrates some of the weld 134 extent and further shows the gaps formed by the passage 142 between the manifold flange 112 and the inner housing 110.

INDUSTRIAL APPLICABILITY

In one illustrative example, an internal combustion engine 100 can include an exhaust system that includes exhaust manifold assembly 106. The exhaust manifold assembly 106 is configured to accommodate both a high temperature exhaust gas from products of combustion and a lower temperature coolant flow.

The present application additionally contemplates a method of assembling an exhaust manifold for an internal combustion engine. The method can include inserting a plurality of manifold flanges 112 within recesses 150 in an outer housing 108. The method can include positioning one or more portions of an inner housing 110 within the outer housing 108 such as illustrated in FIG. 7. The method can include adjusting a position of the outer housing 108 relative to one or more of the plurality of manifold flanges 112 as shown in FIG. 10B. The method can include welding the outer housing 108 to the plurality of manifold flanges 112 adjacent and/or along the outer perimeter region 152 of the sleeve portion 136. The method can include coupling the outer housing 108 to the inner housing 110 at the first end flange 114. The method can additionally include coupling the exhaust manifold assembly 106 to a cylinder head 104 (FIG. 1) via a plurality of bolt bosses 140 of the plurality of manifold flanges 112. The method can include casting the plurality of manifold flanges 112 such that at least two of the plurality of bolt bosses 140 are integrated with a corresponding one of the sleeve portion 136.

The exhaust manifold assembly 106 is designed for manufacturability and durability. As such, the exhaust manifold assembly 106 utilizes a plurality of manifold flanges 112 that overlap with the outer housing 108. As a result of this construction, the manifold flanges 112 can be more easily welded and can be welded in a more uniform manner to the outer housing 108. This can reduce assembly complexity and reduce instances of weld fatigue failure. Additionally, as the outer housing 108 is position adjustable relative to the inner housing 110 and the plurality of manifold flanges 112, tolerance stack up issues during assembly of the exhaust manifold assembly 106 can be reduced or avoided. Providing for water or other coolant flow along the exhaust manifold assembly 106 can improve durability of components such as the plurality of manifold flanges 112 and the first end flange 114 and can reduce weld fatigue cracking and discoloration.

The above detailed description is intended to be illustrative, and not restrictive. The scope of the disclosure should, therefore, be determined with references to the appended claims, along with the full scope of equivalents to which such claims are entitled.

What is claimed is:

1. An exhaust manifold assembly for an internal combustion engine, comprising:

an inner housing configured to receive an exhaust gas from a cylinder head of the internal combustion engine;

an outer housing receiving at least a portion of the inner housing, wherein the outer housing is configured to receive a coolant flow that passes over the at least the portion of the inner housing; and a plurality of manifold flanges coupled to the outer housing and configured to mount on the cylinder head, wherein at least one of the plurality of manifold flanges has a sleeve portion forming a passage that receives a part of the inner housing therein and receives the coolant flow;

wherein the passage of the sleeve portion has a first converging region, a diverging region and a second converging region for the coolant flow.

2. The exhaust manifold assembly of claim 1, further comprising a first end flange that forms at least a portion of a first end of the exhaust manifold assembly, wherein the first end flange is coupled to the outer housing and the inner housing, and wherein the first end flange is configured to receive the coolant flow within a pocket therein.

3. The exhaust manifold assembly of claim 1, wherein an outer perimeter region of the sleeve portion is received within the outer housing.

4. The exhaust manifold assembly of claim 3, wherein the outer housing is moveable relative to the at least one of the plurality of manifold flanges to adjust a position of the outer housing relative to the plurality of manifold flanges prior to the outer housing being coupled to the plurality of manifold flanges.

5. The exhaust manifold assembly of claim 3, wherein the sleeve portion is welded to the outer housing adjacent to and along the outer perimeter region.

6. The exhaust manifold assembly of claim 1, wherein the at least one of the plurality of manifold flanges has a bolt boss that is integrated with the sleeve portion.

7. A method of assembling an exhaust manifold for an internal combustion engine, comprising:

inserting a plurality of manifold flanges within recesses in an outer housing;

positioning one or more portions of an inner housing within the outer housing;

adjusting a position of the outer housing relative to one or more of the plurality of manifold flanges;

welding the outer housing to the plurality of manifold flanges adjacent an outer perimeter region of a sleeve portion; and coupling the outer housing to the inner housing at a first end flange;

wherein the sleeve portion forms a passage that receives a part of the inner housing therein and is configured to receive a coolant flow therein;

wherein the passage of the sleeve portion has a first converging region, a diverging region and a second converging region configured for passage of the coolant flow.

8. The method of claim 7, wherein the first end flange has a pocket configured to receive a coolant flow therein.

9. The method of claim 7, further comprising coupling the exhaust manifold to a cylinder head via a plurality of bolt bosses of the plurality of manifold flanges.

10. The method of claim 9, further comprising casting the plurality of manifold flanges such that at least two of the plurality of bolt bosses are integrated with a corresponding one of the sleeve portion.

11. An internal combustion engine comprising:

an engine block;

a cylinder head coupled to the engine block; and an exhaust manifold assembly coupled to the cylinder head, the exhaust manifold assembly comprising:

an inner housing receiving an exhaust gas from the cylinder head;

an outer housing receiving at least a portion of the inner housing and receiving a coolant flow that passes along a length of the outer housing between the inner housing and the outer housing; and a plurality of manifold flanges coupled to the outer housing and spaced from one another along the length thereof, wherein the plurality of manifold flanges are mounted on the cylinder head, wherein each of the plurality of manifold flanges has a sleeve portion forming a passage that receives a part of the inner housing therein and receives the coolant flow; and wherein the exhaust manifold assembly further includes a first end flange that forms at least a portion of a first end of the exhaust manifold assembly, wherein the first end flange is coupled to the outer housing and the inner housing, and wherein the first end flange is configured to receive the coolant flow within a pocket therein, wherein the first end flange has a triangular shape and the inner housing and the outer housing have a tube-like shape.

12. The internal combustion engine of claim 11, wherein an outer perimeter region of the sleeve portion is received within the outer housing.

13. The internal combustion engine of claim 12, wherein the outer housing is moveable relative to the plurality of manifold flanges to adjust a position of the outer housing relative to the plurality of manifold flanges prior to the outer housing being welded to the plurality of manifold flanges.

14. The internal combustion engine of claim 12, wherein the sleeve portion is welded to the outer housing immediately adjacent and along the outer perimeter region.

15. The internal combustion engine of claim 11, wherein each of the plurality of manifold flanges has a bolt boss that is integrated with the sleeve portion.

16. The internal combustion engine of claim 11, wherein the passage of the sleeve portion has a first converging region, a diverging region and a second converging region for the coolant flow.

* * * * *